US006634424B2

(12) United States Patent
Knowles

(10) Patent No.: US 6,634,424 B2
(45) Date of Patent: Oct. 21, 2003

(54) DOWNHOLE CONTROL TOOL

(75) Inventor: David George Knowles, West Yorkshire (GB)

(73) Assignee: Millennia Engineering Limited, West Yorkshire (GB)

( * ) Notice: Subject to any disclaimer, the term of this patent is extended or adjusted under 35 U.S.C. 154(b) by 0 days.

(21) Appl. No.: 09/947,942

(22) Filed: Sep. 5, 2001

(65) Prior Publication Data

US 2002/0079103 A1 Jun. 27, 2002

(30) Foreign Application Priority Data

Sep. 5, 2000 (GB) ..... 0021740

(51) Int. Cl.[7] ..... E21B 33/10
(52) U.S. Cl. ..... 166/237; 166/332.2; 74/88
(58) Field of Search ..... 166/321, 332.2, 166/334.1, 334.3, 334.4, 237; 192/69.8, 69.81, 86 A; 74/22 R, 22 A, 56, 88

(56) References Cited

U.S. PATENT DOCUMENTS 3,703,104 A 11/1972 Tamplen ..... 74/88
4,256,179 A 3/1981 Shillander ..... 166/237
4,560,005 A * 12/1985 Helderle et al. ..... 166/332
4,799,554 A * 1/1989 Clapp et al. ..... 166/312
5,222,559 A * 6/1993 Edwards et al. ..... 166/321
5,787,981 A * 8/1998 Taylor ..... 166/237

* cited by examiner

*Primary Examiner*—William Neuder
(74) *Attorney, Agent, or Firm*—Stephen M. Nipper; Robert L. Shaver; Frank J. Dykas

(57) ABSTRACT

A downhole control tool (20) comprises a first sleeve (22) defining a first profile (28), a second sleeve (24) axially and rotatably movable relative to the first sleeve (22) and defining a second profile (30) for selectively engaging the first profile (28), and a third sleeve (26) axially movable relative to the first sleeve (22) and defining a third profile (36) for selectively engaging the second profile (30). The profiles are engaged and disengaged by axial reciprocal movement of the third sleeve (26). The profiles are arranged such that on the second profile (30) engaging the first profile (28) and the second profile (30) engaging the third profile (36), the second sleeve (24) is rotated relative to the first sleeve (22). Thus, the tool (20) provides an arrangement which converts a reciprocal movement into a rotary movement.

29 Claims, 13 Drawing Sheets

DOWNHOLE CONTROL TOOL

PRIORITY

This application claims priority of United Kingdom Patent Application No. 0021740.6 entitled "DOWNHOLE CONTROL TOOL," filed on Sep. 05, 2000.

DESCRIPTION

1. Field of the Invention

This invention relates to a downhole control tool.

2. Background of the Invention

In the oil and gas exploration and production industry, complex tools and devices will often be located in deep well bores. Control of such tools and devices from the surface may be affected by many different means, including control lines carrying electrical conductors, fiber optic cables or hydraulic fluid. The pressure of the fluid in the well, or of a fluid in a tubular in the well, may also be utilized. In many instances, a single well will contain a number of different tools and devices, all requiring separate control. Clearly, as the number of tools and devices increases, it becomes more difficult to provide separate control arrangements for the tools, for example it may become impractical to provide a separate hydraulic fluid control line for each tool or device.

It is among the objectives of embodiments of the present invention to facilitate control and operation of multiple downhole tools.

SUMMARY OF THE INVENTION

According to the present invention there is provided a downhole control tool comprising:

a first member defining a first profile;

a second member axially and rotatably movable relative to the first member and defining a second profile for selectively engaging the first profile; and a third member axially movable relative to the first member and defining a third profile for selectively engaging the second profile, the profiles being engaged and disengaged by axial reciprocal movement of the third member; and the profiles being arranged such that on at least one of the second profile engaging the first profile and the second profile engaging the third profile, the second member is rotated relative to the first member.

Thus, the present invention provides an arrangement which converts a reciprocal movement into a rotary movement, which is useful in many applications, as will be described.

Preferably, the second member is a tool or device actuating member for selectively actuating a tool or device when the member is in a selected rotational or axial position. Typically, the member will actuate a tool or device only when in a predetermined axial and rotational position, the position having been attained by a predetermined number of reciprocal movements of the third member. Most preferably, the tool comprises at least one valve for selective actuation by the second member. The at least one valve may be a shuttle valve. The valve may be normally closed, and is actuated to the open position by the second member. The valve may control fluid access to a control line for selectively actuating a respective tool or device. A plurality of individually actuatable valves may be provided. Of course the tool of the invention may be provided in combination with a wide range of other tools or devices and for use in actuating other tools and devices, in addition to valves.

Preferably, the second member is axially biased towards the first member, that is the second profile is biased towards engagement with the first profile.

Preferably, the third member is axially biased away from the second member, that is the third profile is axially biased out of engagement with the second profile.

Preferably, the members are annular members, such that the tool may be incorporated in a tubular string, and allow fluid or other means of communication therethrough.

Preferably, the profiles are annular and continuous, such that the second member may be rotated indefinitely.

Preferably, rotation of the second member is induced both by engagement of the first and second profiles and by engagement of the second and third profiles.

Preferably, the profiles comprise teeth.

The second profile may be in two parts, one part for engaging the first profile and another part for engaging the third profile. However, it is preferred that the second profile is in one part, for selectively engaging both the first and the third profiles.

Preferably, the third member is fluid actuated. Most preferably, the member defines a piston, but may alternatively define some other flow restriction or profile. In other embodiments the member may be actuatable by other means.

Preferably, the second member is located co-axially within the first member. The members may define co-operating slots, splines or other profiles to permit relative axial movement therebetween.

BRIEF DESCRIPTION OF THE DRAWINGS

This and other aspects of the present invention will now be described by way of example, with reference to the accompanying drawings, in which.

DETAILED DESCRIPTION OF THE DRAWINGS

Figure 1:
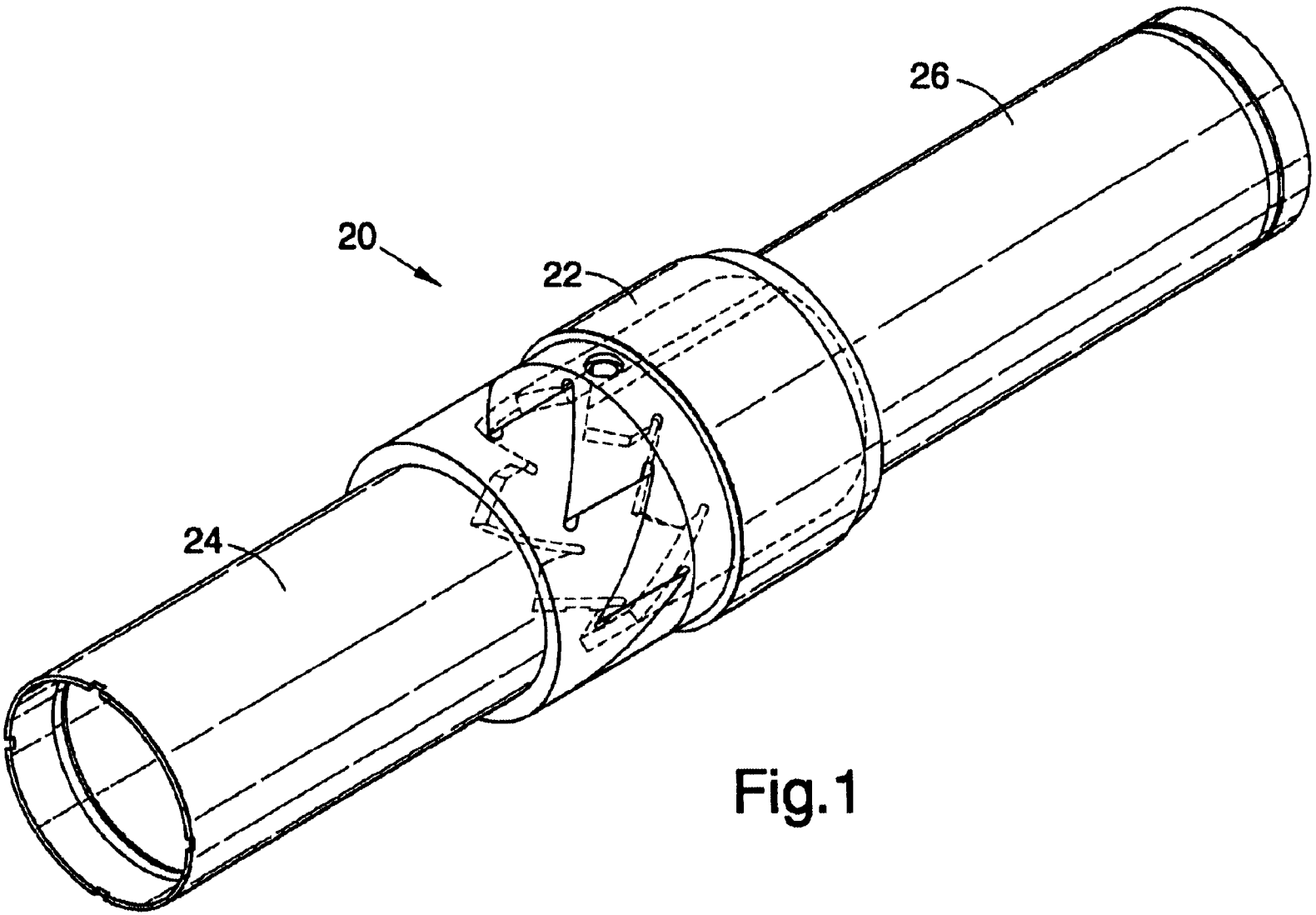
FIG. 1 is a schematic perspective view of an indexing mechanism of a downhole control tool in accordance with an embodiment of the present invention.
Figure 2:
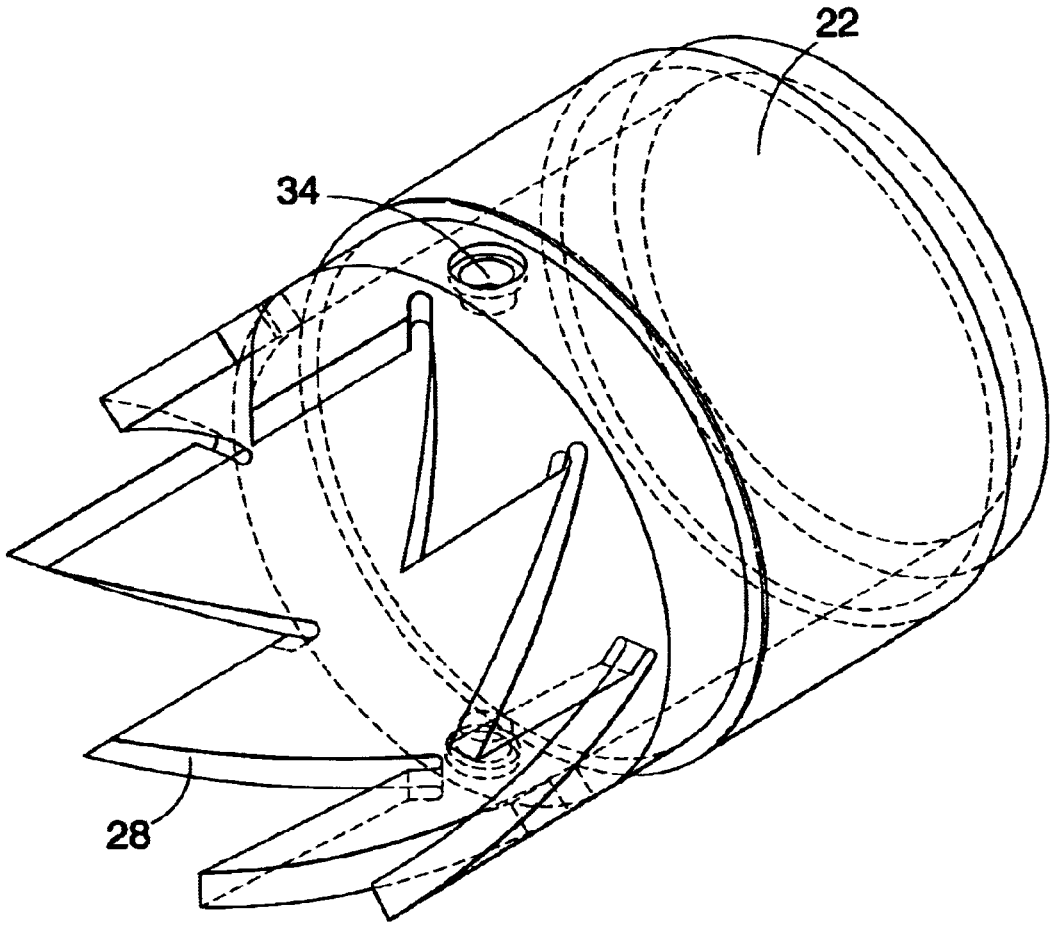
FIG. 2 is a view of a fixed sleeve of the mechanism of FIG. 1.
Figure 3:
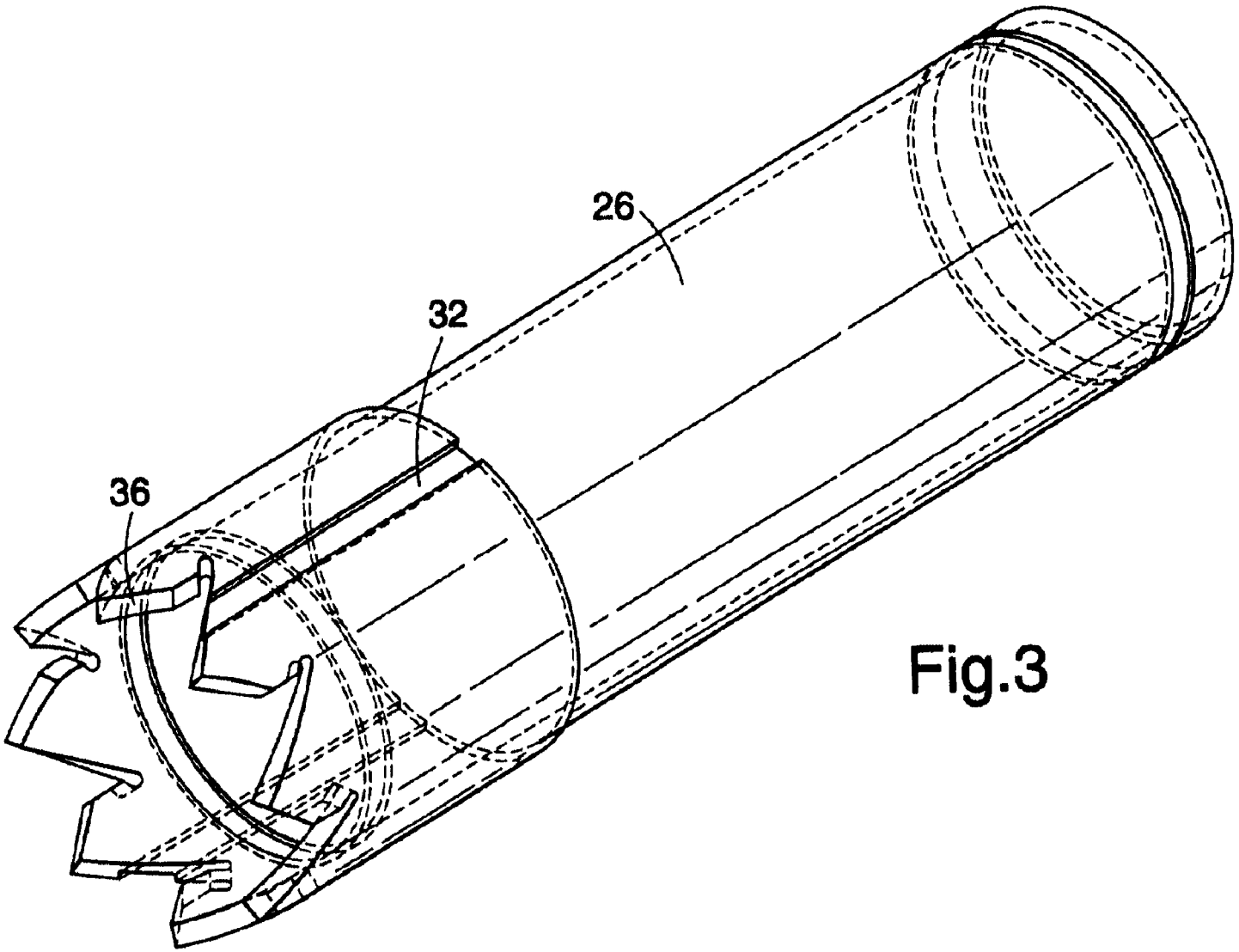
FIG. 3 is a view of a sliding sleeve of the mechanism of FIG. 1.
Figure 4:
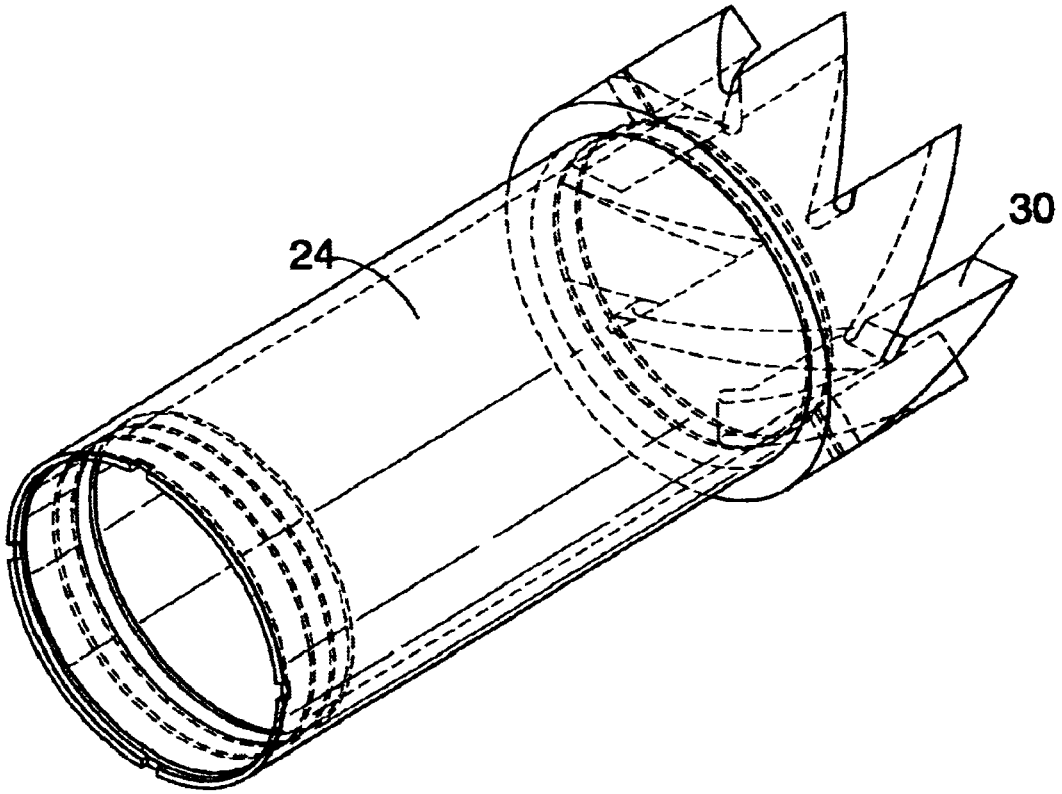
FIG. 4 is a view of a rotary sleeve of the mechanism of FIG. 1.

Reference is first made to FIGS. 1 to 4 of the drawings, which are schematic perspective views of an indexing mechanism 20 in accordance with a preferred embodiment of the present invention. As will be described, the mechanism 20 may be utilized to convert a simple reciprocal movement into a combination of rotational and longitudinal movement, which in this instance is utilized to facilitate control of a number of fluid actuated tools or devices. Following a description of the main elements of the mechanism, the indexing operation will be described with reference to FIGS. 5 to 11 of the drawings, followed by a description of a tool incorporating the mechanism, with reference to FIGS. 12 and 13.

The mechanism comprises three main components: a first member in the form of a fixed sleeve 22, a second member in the form of an axially movable and rotatable sleeve 24, and a third member mounted within the fixed sleeve 22, in the form of a sliding sleeve 26.

The fixed sleeve 22 defines a first dogtooth profile 28 which engages a corresponding dogtooth profile 30 on the rotating sleeve 24. The sliding sleeve 26 defines axial splines 32 which engage the inner ends of corresponding pins 34 mounted on the fixed sleeve 22, and the sleeve 26 is axially movable relative to the fixed sleeve 22. The sliding sleeve 26 defines a V-tooth profile 36 which selectively engages the rotating sleeve profile 30.

Figure 5:
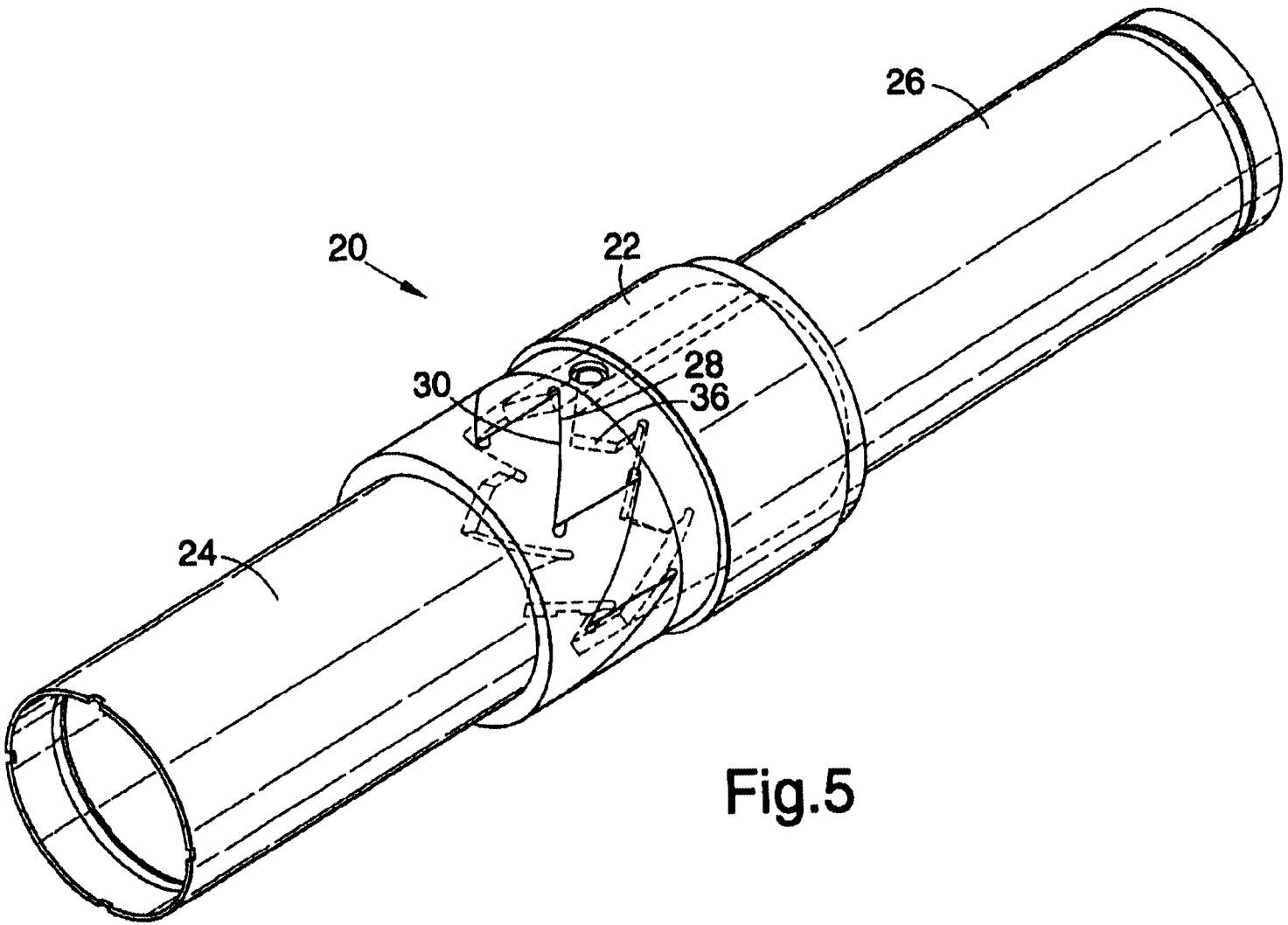
FIGS. 5 to 11 are views of the mechanism of FIG. 1 showing sequential indexing positions of the mechanism.

FIG. 5 illustrates an initial configuration, in which the rotating sleeve profile 30 engages the fixed sleeve tooth profile 28. The sliding sleeve 26 is in a retracted position, with the sleeve profile 36 disengaged from the rotating sleeve profile 30. Both the rotating sleeve 24 and the sliding sleeve 26 are biased towards their respective initial or retracted positions, as illustrated in FIG. 5.

Figure 6:
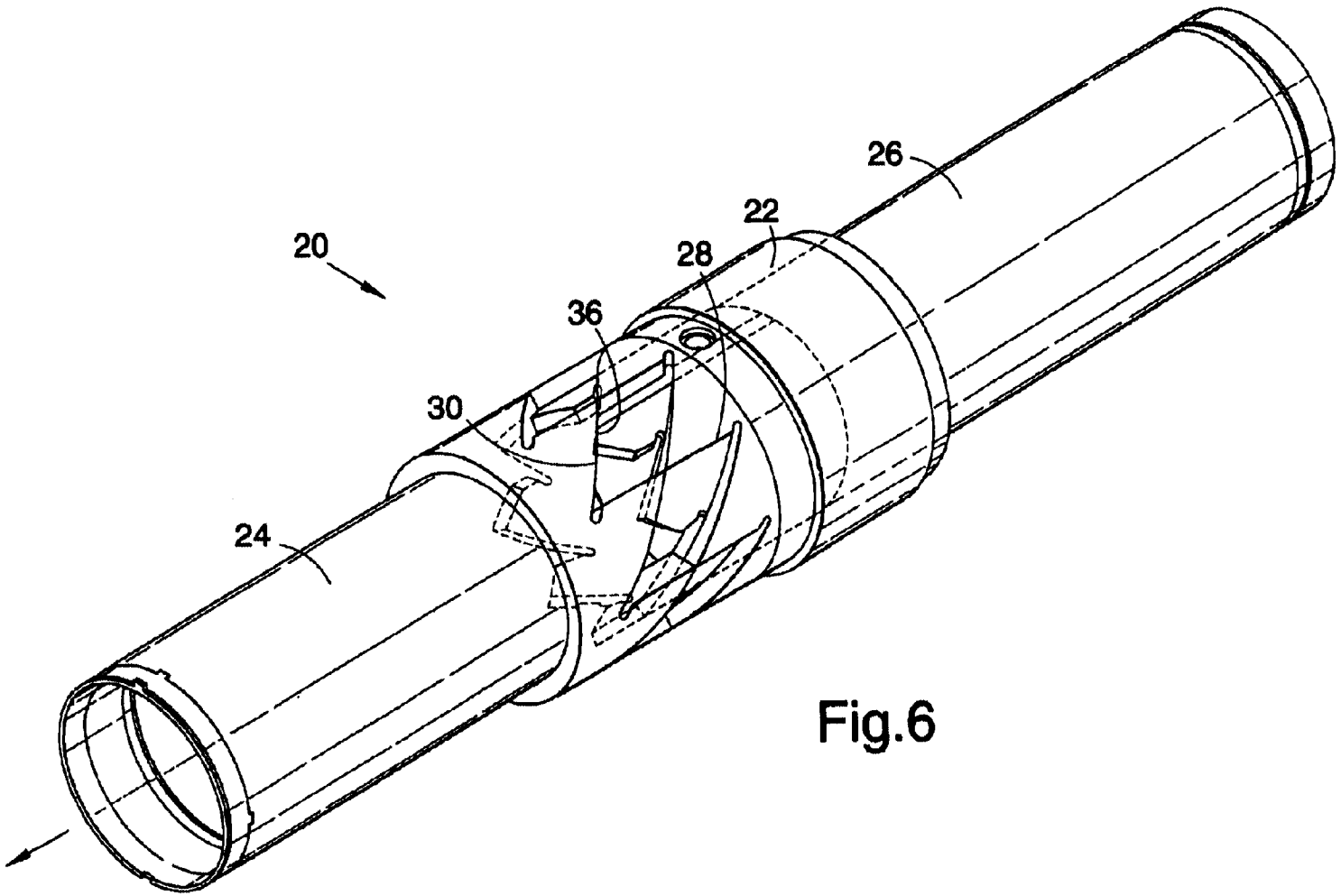

When the sliding sleeve 26 is initially extended, by fluid pressure force, as illustrated in FIG. 6, the sliding sleeve profile 36 engages the rotating sleeve profile 30, which at this point is still in engagement with the fixed sleeve profile 28.

Figure 7:
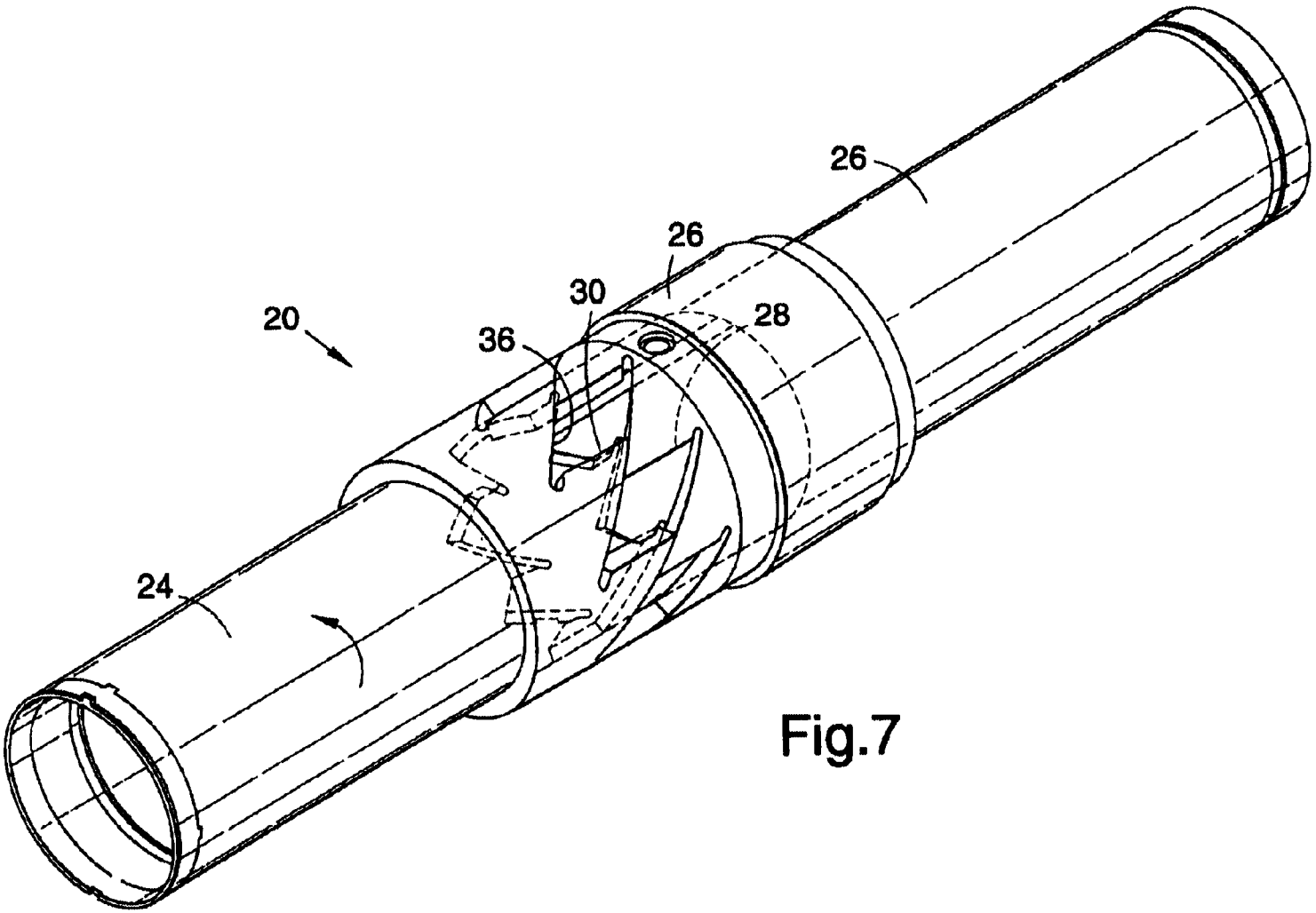
Figure 8:
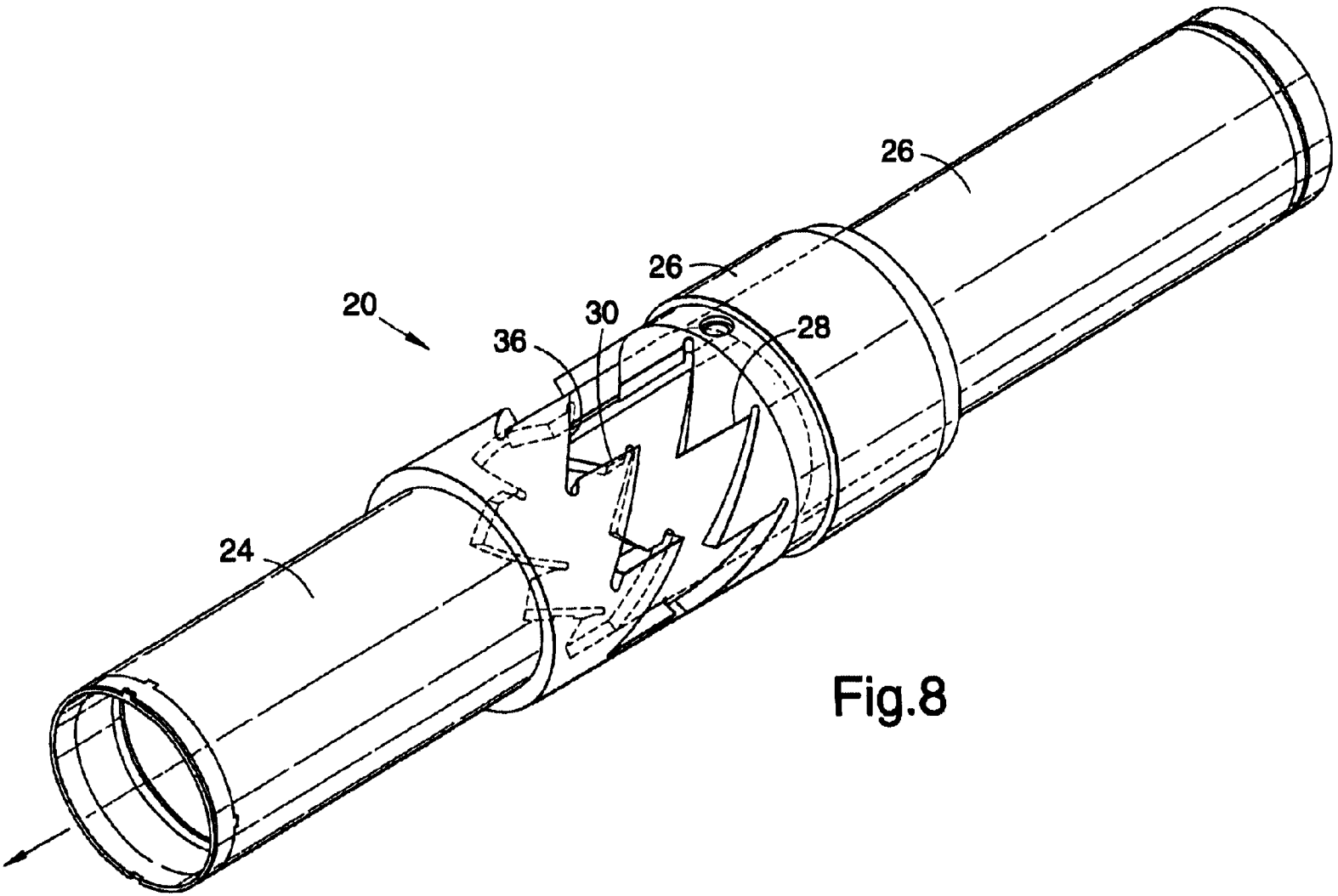

As the sliding sleeve 26 extends further, as illustrated in FIG. 7, the sleeve 26 pushes the rotating sleeve profile 30 out of engagement with the fixed tooth profile 28. Due to the relative positioning and orientation of the mating faces of the profiles 28, 36, the rotating sleeve 24 then rotates relative to the rotationally fixed sliding sleeve 26. Still further extension of the sliding sleeve 26, as illustrated in FIG. 8, moves the rotating sleeve 24 axially to an extended position where, as will be described, to sleeve 24 may be utilized to actuate a further tool or device.

Figure 9:
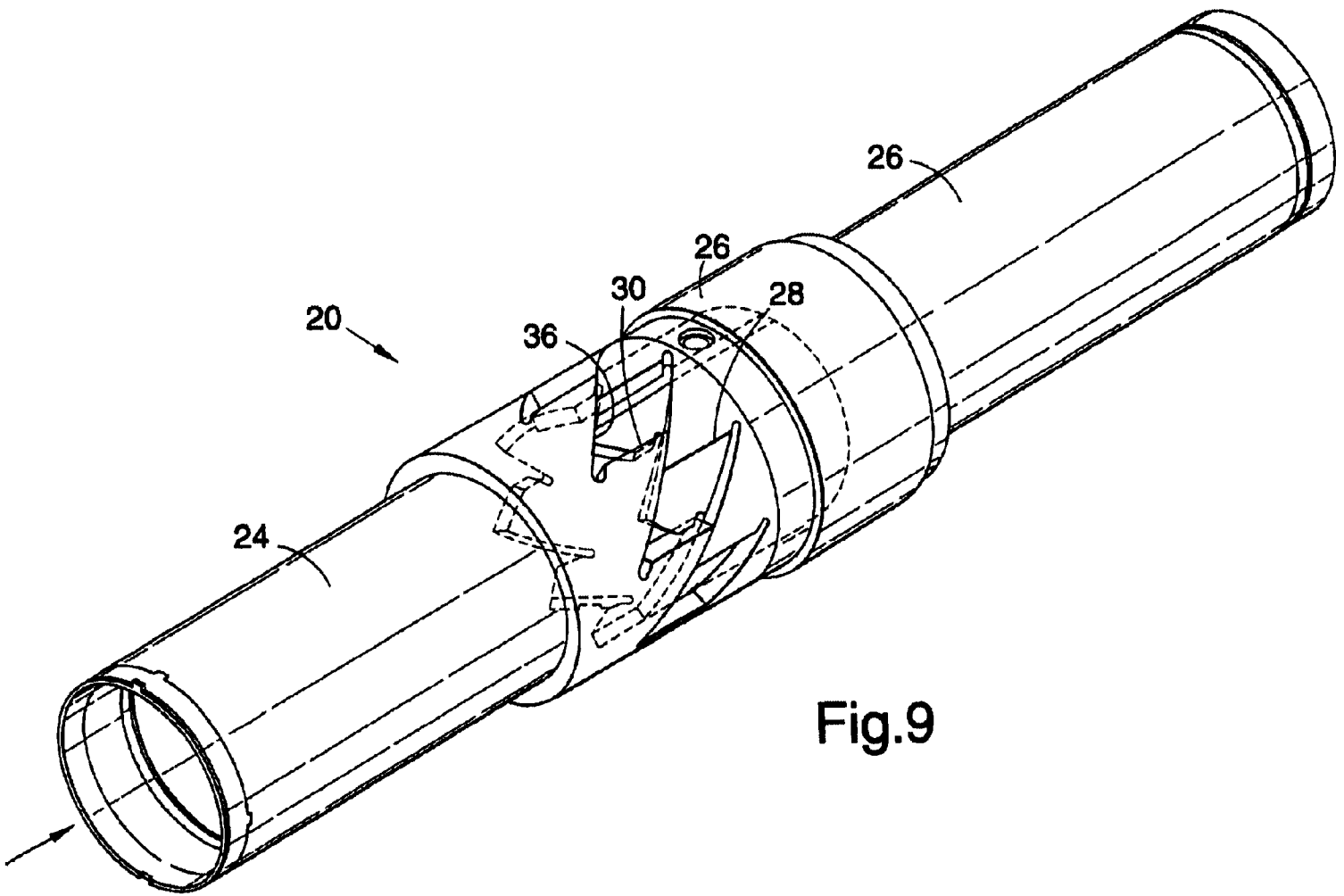
Figure 10:
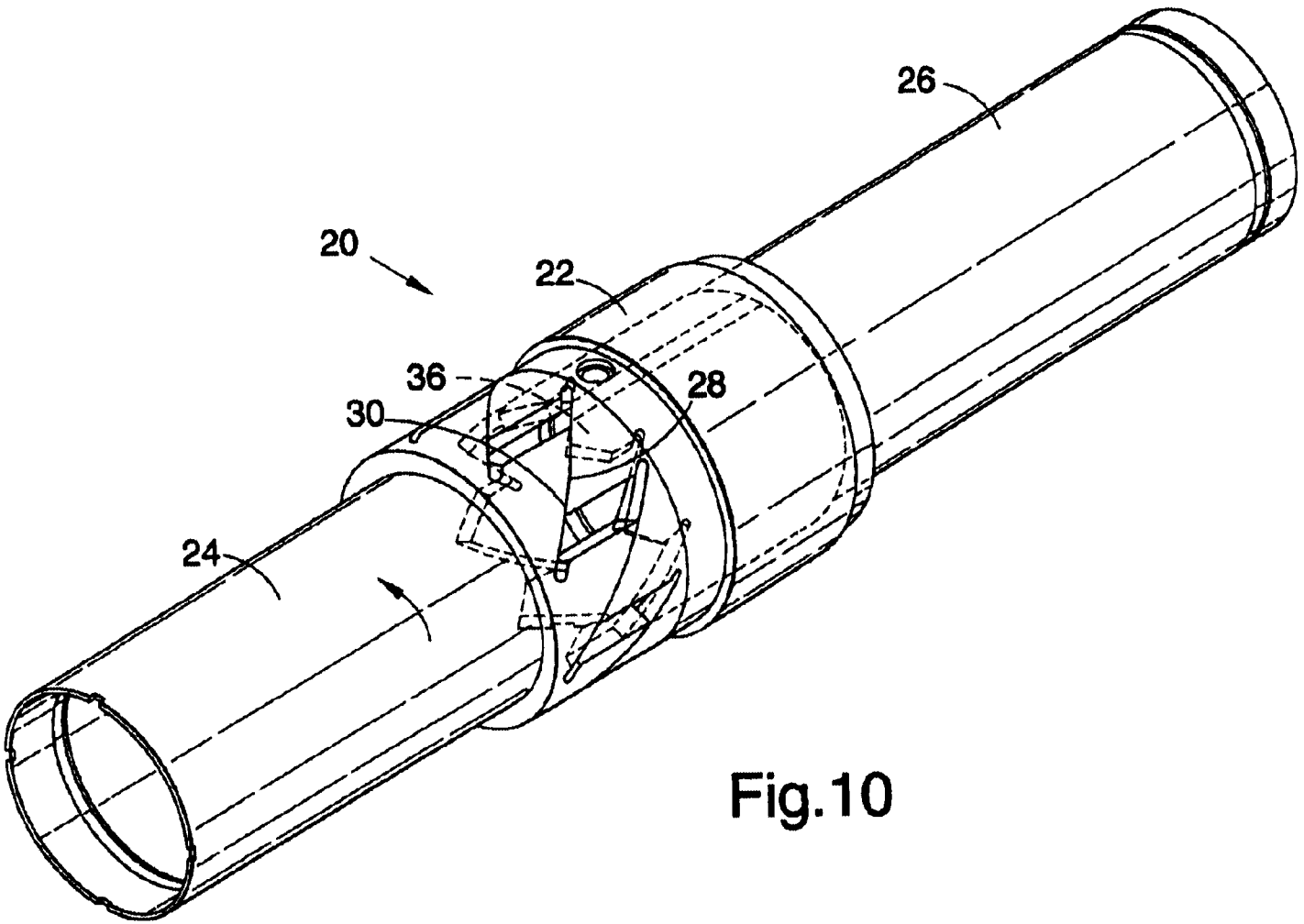
Figure 11:
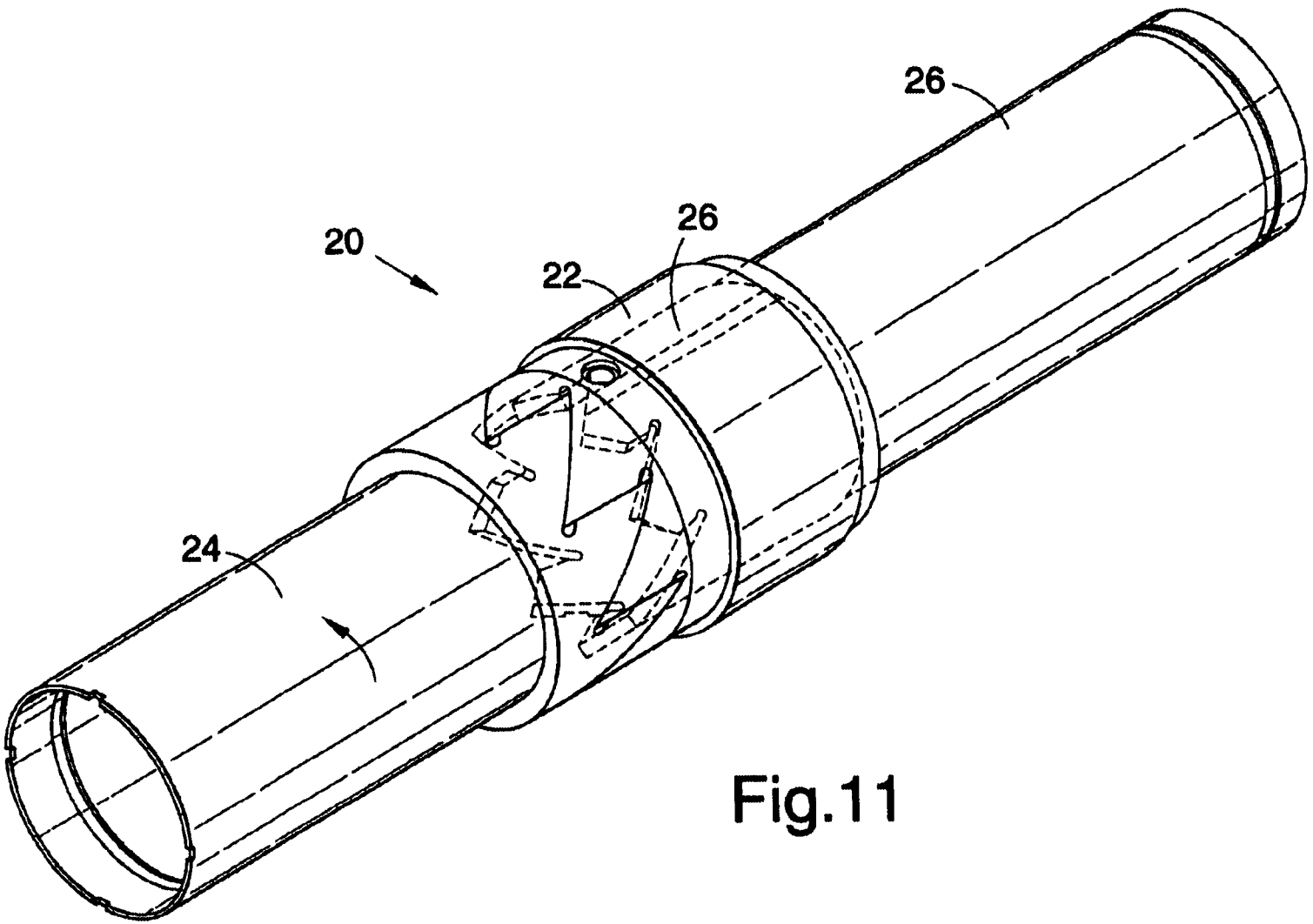

If the sliding sleeve 26 is then retracted, both sleeves 24, 26 move back axially, as illustrated in FIG. 9, until the rotating sleeve profile 30 engages the fixed sleeve profile 28 again. On further retraction of the sliding sleeve 26, the rotating sleeve profile 30 clears the sliding sleeve profile 36, as illustrated in FIGS. 10 and 11, causing the rotating sleeve 24 to rotate further as the profiles 28, 30 fully engage.

When the sliding sleeve 26 is next extended, the process is repeated, the rotating sleeve 24 being rotated through a predetermined angle each time the sleeve 26 is extended and then retracted.

Figure 12:
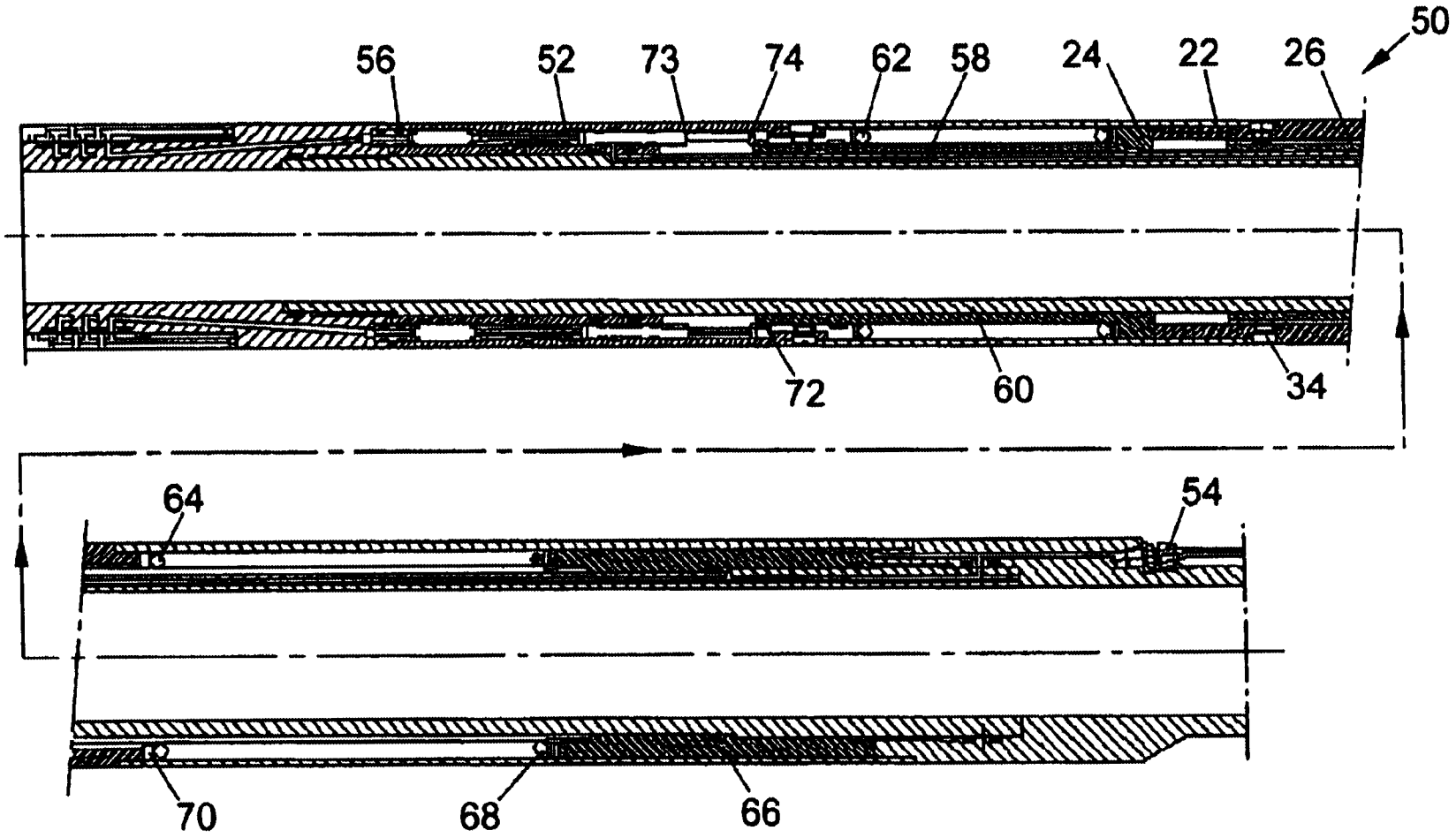
FIGS. 12 and 13 are sectional views of a downhole control tool in accordance with a preferred embodiment of the present invention.
Figures 13, 14:
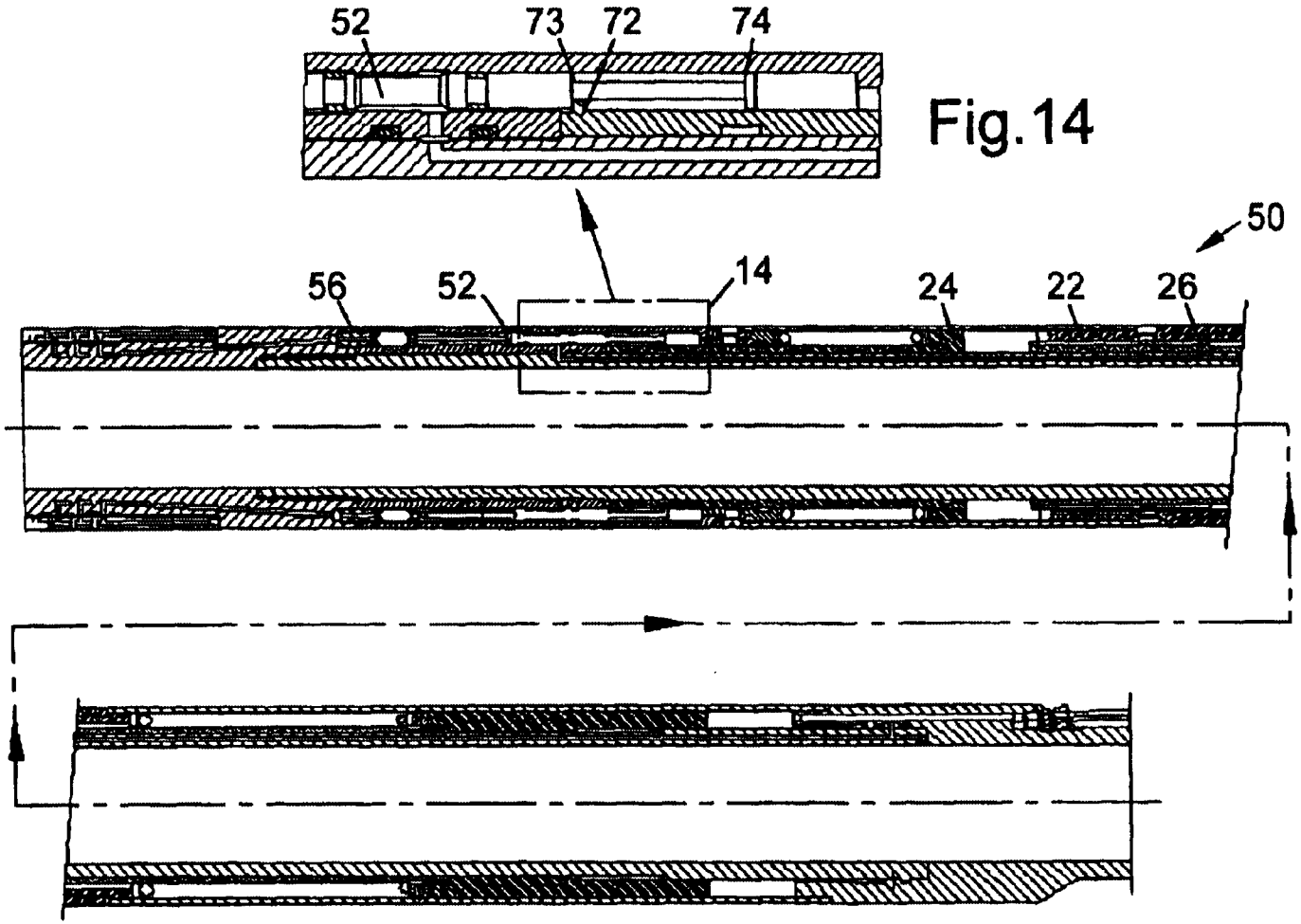
FIG. 14 is an enlarged view of area 14 of FIG. 13.

Reference is now made to FIGS. 12, 13 and 14, which illustrate a hydraulic control tool 50, incorporating an indexing mechanism 20 as described above. The tool 50 is utilized to control the opening and closing of a shuttle valve 52 which controls fluid communication between a hydraulic fluid inlet line 54 and a hydraulic fluid outlet line 56, the lines 54 and 56 being coupled by porting 58 through the wall of the tubular tool body 60.

As was noted above, the rotating sleeve 24 and the sliding sleeve 26 are biased to initial or retracted positions, in this example by respective compression springs 62, 64. The sliding sleeve 26 is coupled to a hydraulic piston 66 in communication with the fluid inlet line 54, the piston 66 including a shoulder 68 which bears on one end of the sliding sleeve return spring 64, the other end of the spring 64 engaging a shoulder 70 abutting the end of the fixed sleeve 22.

FIG. 12 shows the tool 50 in an initial configuration, with the sleeves 24, 26 retracted and the shuttle valve 52 closed. However, by reciprocating the sliding sleeve 26, by raising and lowering the pressure of the fluid supplied to control line 54, the sleeve 24 may be rotated and extended until a toe 72 on the leading end of the sleeve 24 engages a shoulder 73 on the shuttle valve 52 (FIG. 14), opening the valve 52, allowing fluid to be supplied to the outlet control line 56, and a fluid actuated valve or other tool or device to be actuated. When the sleeve 24 retracts, the valve 52 is closed by the toe 72 engaging a further shoulder 74 on the valve 52. After the valve 52 has been closed, the sleeve 24 rotates, disengaging the toe 72 from the shoulder 74.

The tool may include a plurality of valves, each opened or closed by the sleeve 24 as it reaches a predetermined rotational position.

Those of skill in the art will recognize that the mechanism 20 may be utilized in a wide range of downhole tools and devices in addition to the application described above, where it is desired to remotely control the operation or actuation of one or more further tools or devices. It will further be apparent to those of skill in the art that the mechanism 20 may alternatively be actuated by internal tubing pressure, annulus pressure, using coil tubing or mechanically, and that the sleeve 14 may also be utilized to, for example, close valves, open or close switches, release keys, or indeed execute or actuate a wide range of downhole operations.

I claim:

1. A downhole control tool comprising:

a first member defining a first profile;

a second member axially and rotatably movable relative to the first member and defining a second profile for selectively engaging the first profile; and a third member axially movable relative to the first member and defining a third profile for selectively engaging the second profile;

the profiles being arranged to be engaged and disengaged by axial reciprocal movement of the third member; and the profiles further being arranged such that on at least one of the second profile engaging the first profile and the second profile engaging the third profile, the second member is rotated relative to the first member.

2. The tool of claim 1, further comprising a selectively actuatable downhole device and wherein the second member is adapted for selectively actuating the device when the second member is in a selected position.

3. The tool of claim 2, wherein the second member is adapted to actuate the device only when in a predetermined axial position.

4. The tool of claim 2, wherein the second member is adapted to actuate the device only when in a predetermined rotational position.

5. The tool of claim 2, wherein the second member is adapted to actuate the device only when in a predetermined axial and rotational position.

6. The tool of claim 2, wherein the second member is arranged to attain a device-actuating position following a predetermined number of reciprocal movements of the third member.

7. The tool of claim 2, wherein said device is at least one valve for selective actuation by the second member.

8. The tool of claim 7, wherein said at least one valve is a shuttle valve.

9. The tool of claim 7, wherein the valve is normally closed, and is arranged to be moved to the open position by the second member.

10. The tool of claim 7, wherein the valve is adapted to control fluid access to a control line.

11. The tool of claim 7, wherein a plurality of individually actuatable valves are provided.

12. The tool of claim 1, wherein the second member is axially biased towards the first member.

13. The tool of claim 1, wherein the third member is axially biased away from the second member.

14. The tool of claim 1, wherein the members are annular members.

15. The tool of claim 14, wherein the tool is adapted to be incorporated in a tubular string.

16. The tool of claim 1, wherein rotation of the second member is induced both by engagement of the first and second profiles and by engagement of the second and third profiles.

17. The tool of claim 1, wherein the profiles comprise teeth.

18. The tool of claim 17, wherein the first profile is in the form of a dogtooth profile.

19. The tool of claim 17, wherein the second profile is in the form of a dogtooth profile.

20. The tool of claim 17, wherein the third profile is in the form of a V-tooth profile.

21. The tool of claim 1, wherein the third member is fluid actuated.

22. The tool of claim 21, wherein the third member defines a piston.

23. The tool of claim 1, wherein the second member is located co-axially within the first member.

24. The tool of claim 23, wherein the first and third members define co-operating means for permitting relative axial movement but restricting rotational movement therebetween.

25. The tool of claim 1, wherein at least one of the profiles is continuous.

26. A downhole control tool comprising:

a first member defining a first profile;

a second member axially and rotatably movable relative to the first member and defining a second profile for selectively engaging the first profile; and a third member axially movable relative to the first member and defining a third profile for selectively engaging the second profile;

the profiles being arranged to be engaged and disengaged by axial reciprocal movement of the third member; and the second member arranged to be rotated relative to the first member on the second profile engaging the first profile and on the second profile engaging the third profile.

27. A downhole control tool comprising:

a first member defining a first profile;

a second member axially and rotatably movable relative to the first member and defining a second profile for selectively engaging the first profile;

a third member axially movable relative to the first member and defining a third profile for selectively engaging the second profile; and a selectively actuatable downhole device;

the profiles being arranged to be engaged and disengaged by axial reciprocal movement of the third member;

the profiles further being arranged such that on at least one of the second profile engaging the first profile and the second profile engaging the third profile, the second member is rotated relative to the first member; and the second member being adapted to attain a device-actuating position for selectively actuating the downhole device following a predetermined number of reciprocal movements of the third member.

28. A downhole control tool comprising:

a first member defining a first profile;

a second member axially and rotatably movable relative to the first member and defining a second profile for selectively engaging the first profile; and a third member axially movable relative to the first member and defining a third profile for selectively engaging the second profile; and a valve;

the profiles being arranged to be engaged and disengaged by axial reciprocal movement of the third member;

the profiles further being arranged such that on at least one of the second profile engaging the first profile and the second profile engaging the third profile, the second member is rotated relative to the first member; and the second member adapted for selectively actuating the valve when the second member is in a selected position.

29. A downhole control tool comprising:

a first member defining a first profile;

a second member located co-axially within the first member, the second member axially rid rotatably movable relative to the first member and defining a second profile for selectively engaging the first profile; and a third member axially movable relative to the first member and defining a third profile selectively engaging the second profile;

the profiles being arranged to be engaged and disengaged by axial reciprocal movement the third member; and the profiles further being arranged such that on at least one of the second profile engaging Le first profile and the second profile engaging the third profile, the second member is rotated relative to the first member.

* * * * *